US012185836B1

(12) United States Patent
Johnson

(10) Patent No.: US 12,185,836 B1
(45) Date of Patent: Jan. 7, 2025

(54) HEIGHT ADJUSTABLE DESK

(71) Applicant: Ronald B. Johnson, Honokaa, HI (US)

(72) Inventor: Ronald B. Johnson, Honokaa, HI (US)

( * ) Notice: Subject to any disclaimer, the term of this patent is extended or adjusted under 35 U.S.C. 154(b) by 253 days.

(21) Appl. No.: 17/868,034

(22) Filed: Jul. 19, 2022

(51) Int. Cl.
*A47B 9/16* (2006.01)

(52) U.S. Cl.
CPC ..... *A47B 9/16* (2013.01)

(58) Field of Classification Search
CPC .... A47B 9/16; A47B 2200/0041; A47B 17/02
USPC ..... 108/145, 116, 118; 248/164, 166, 421, 248/585, 281.11
See application file for complete search history.

(56) References Cited

U.S. PATENT DOCUMENTS

| | | | | |
|---|---|---|---|---|
| 187,361 | A * | 2/1877 | Davis | |
| 521,256 | A * | 6/1894 | Browne | |
| 2,194,390 | A | 3/1940 | Hubbard | |
| 2,772,881 | A | 12/1956 | Jane | |
| 3,233,859 | A * | 2/1966 | Beoletto | B60N 2/502 248/585 |
| 3,756,595 | A | 9/1973 | Hague | |
| 3,970,302 | A | 7/1976 | McFee | |
| 4,023,795 | A | 5/1977 | Pauls | |
| 4,402,506 | A | 9/1983 | Jones | |
| 4,434,981 | A | 3/1984 | Norton | |
| 4,496,147 | A | 1/1985 | DeCloux | |
| 4,529,194 | A | 7/1985 | Haaheim | |
| 4,645,201 | A | 2/1987 | Evans | |
| 4,659,077 | A | 4/1987 | Stropkay | |
| 4,666,119 | A * | 5/1987 | Dose | B63B 29/04 248/421 |
| 4,679,786 | A | 7/1987 | Rodgers | |
| 4,709,918 | A | 12/1987 | Grinblat | |
| 4,733,858 | A | 3/1988 | Lan | |
| 4,850,585 | A | 7/1989 | Dalebout | |
| 4,867,443 | A | 9/1989 | Jensen | |
| 5,242,343 | A | 9/1993 | Miller | |
| 5,299,993 | A | 4/1994 | Habing | |
| 5,336,141 | A | 8/1994 | Vittone | |
| 5,383,829 | A | 1/1995 | Miller | |
| 5,419,747 | A | 5/1995 | Piaget et al. | |
| 5,496,235 | A | 3/1996 | Stevens | |

(Continued)

FOREIGN PATENT DOCUMENTS

| | | | |
|---|---|---|---|
| CN | 108125386 A | * | 6/2018 |
| CN | 110384334 A | * | 10/2019 |

(Continued)

*Primary Examiner* — Janet M Wilkens
(74) *Attorney, Agent, or Firm* — Booth Udall Fuller, PLC; Kenneth C. Booth

(57) ABSTRACT

An adjustable desk with a desk platform, at least two legs, and a locking mechanism. The legs support the desk platform and make the height of the desk platform adjustable. Each leg has a base, a support coupled to the desk platform, and linkages joining the base to the support. Each linkage has a first link, a second link pivotally coupled to the first link at a first joint, and a third link pivotally coupled to the second link at a second joint. The first link and the third link are pivotally coupled to the base and the second link is pivotally coupled to the support at the top pivot. The first joint is positioned between the top pivot and the second joint and a distance between the first joint and the top pivot may be larger than the distance between the first joint and the second joint.

20 Claims, 10 Drawing Sheets

(56) References Cited

U.S. PATENT DOCUMENTS

| | | | | |
|---|---|---|---|---|
| 5,540,637 | A | 7/1996 | Rogers | |
| 5,575,740 | A | 11/1996 | Piaget et al. | |
| 5,605,521 | A | 2/1997 | Hsieh | |
| 5,735,773 | A | 4/1998 | Vittone et al. | |
| 5,792,029 | A | 8/1998 | Gordon | |
| 5,813,947 | A | 9/1998 | Densmore | |
| 5,857,940 | A | 1/1999 | Husted | |
| 5,971,892 | A | 10/1999 | Lee | |
| 6,019,709 | A | 2/2000 | Piaget | |
| 6,038,986 | A * | 3/2000 | Ransil | A47B 17/02 108/146 |
| 6,117,052 | A | 9/2000 | Frost et al. | |
| 6,135,926 | A | 10/2000 | Lee | |
| 6,206,806 | B1 | 3/2001 | Chu | |
| 6,224,516 | B1 | 5/2001 | Disch | |
| 6,302,830 | B1 | 10/2001 | Stearns | |
| 6,689,019 | B2 | 2/2004 | Ohrt | |
| 6,691,626 | B2 * | 2/2004 | Warner | A47B 9/00 248/421 |
| 6,875,160 | B2 | 4/2005 | Watterson | |
| 7,169,088 | B2 | 1/2007 | Rodgers | |
| 7,614,991 | B2 | 11/2009 | Fox | |
| 7,780,577 | B2 | 8/2010 | Arnold | |
| 7,780,578 | B2 | 8/2010 | Packham | |
| 7,833,134 | B2 | 11/2010 | Gordon | |
| 7,892,148 | B1 | 2/2011 | Stauffer et al. | |
| 8,065,966 | B1 * | 11/2011 | Bacon | A47B 9/16 108/147 |
| 9,486,070 | B2 | 11/2016 | Labrosse et al. | |
| 9,498,671 | B1 | 11/2016 | Softky | |
| 9,511,254 | B2 | 12/2016 | Netter et al. | |
| 9,521,901 | B2 | 12/2016 | Dalebout | |
| 9,750,343 | B2 | 9/2017 | McBride | |
| 9,795,827 | B2 | 10/2017 | Wiener | |
| 9,925,403 | B1 | 3/2018 | Zarli | |
| 9,955,789 | B2 | 5/2018 | Herring et al. | |
| 10,046,197 | B2 | 8/2018 | Gordon | |
| 10,413,777 | B2 | 9/2019 | Hsieh | |
| 11,173,344 | B2 | 11/2021 | Stehlik | |
| 2004/0162191 | A1 | 8/2004 | Ercanbrack et al. | |
| 2004/0176215 | A1 | 9/2004 | Gramaccioni | |
| 2005/0054492 | A1 | 3/2005 | Neff | |
| 2006/0046902 | A1 | 3/2006 | Chang | |
| 2006/0264306 | A1 | 11/2006 | Tischler et al. | |
| 2008/0096745 | A1 | 4/2008 | Perry | |
| 2008/0214364 | A1 | 9/2008 | Maresh et al. | |
| 2008/0167164 | A1 | 11/2008 | Wang | |
| 2012/0088633 | A1 | 4/2012 | Crafton | |
| 2014/0073488 | A1 | 3/2014 | Wu | |
| 2014/0187383 | A1 | 7/2014 | Martin | |
| 2015/0250304 | A1 | 9/2015 | Dalebout | |

FOREIGN PATENT DOCUMENTS

| | | | | |
|---|---|---|---|---|
| EP | 3288427 | | 3/2018 | |
| WO | WO-9952398 | A1 * | 10/1999 | A47B 17/02 |
| WO | WO-2004097269 | A2 * | 11/2004 | A47B 9/02 |

* cited by examiner

HEIGHT ADJUSTABLE DESK

TECHNICAL FIELD

Aspects of this document relate generally to a height adjustable desk, and more specifically to a height adjustable desk with a wide range of adjustability that is adjustable within a comparatively small operation space.

BACKGROUND

Height adjustable desks are popular because they can be adjusted to accommodate workers of different statures. In addition, many workers like to use height adjustable desks to switch back and forth between seated and standing postures. However, many height adjustable desks don't adjust low enough to accommodate smaller workers, and others don't adjust high enough to accommodate larger workers. Many height adjustable desks require the use of tools to adjust their height and others adjust without tools but are still time consuming to adjust. Additionally, many adjustable desks require electricity to power their motors. What is needed is a height adjustable desk with a large range of adjustment that adjusts quickly and easily and doesn't require electricity to operate.

SUMMARY

Aspects of this document relate to an adjustable desk, comprising a desk platform having an adjustable height, at least two legs configured to support the desk platform and allow a user to adjust the height of the desk platform, wherein a difference between a maximum height and a minimum height of the desk platform is at least 13 inches, each leg of the at least two legs comprising a base having a first upper pivot, a first lower pivot, a second upper pivot, and a second lower pivot, a support fixedly coupled to a bottom surface of the desk platform and having a top pivot and a bottom pivot, and a set of linkages joining the base to the support, the set of linkages comprising an upper linkage and a lower linkage, wherein each of the upper linkage and the lower linkage individually comprises a first link, a second link pivotally coupled to the first link at a first joint, and a third link pivotally coupled to the second link at a second joint, wherein the first links of the upper linkage and the lower linkage are pivotally coupled to the base at the first upper pivot and the first lower pivot, respectively, the second links of the upper linkage and the lower linkage are pivotally coupled to the support at the top pivot and the bottom pivot, respectively, and the third links of the upper linkage and the lower linkage are pivotally coupled to the base at the second upper pivot and the second lower pivot, respectively, and wherein the first joints of the upper linkage and the lower linkage are respectively positioned between the top pivot and the second joint of the upper linkage and between the bottom pivot and the second joint of the lower linkage and wherein a distance between the first upper pivot and the first joint of the upper linkage and a distance between the first lower pivot and the first joint of the lower linkage are respectively equal to distances between the first joints and the second joints of the upper linkage and the lower linkage, and a locking mechanism configured to lock the desk platform at a desired height by limiting rotation of the links of each of the sets of linkages.

Particular embodiments may comprise one or more of the following features. A distance between the first joint of the upper linkage and the top pivot and a distance between the first joint of the lower linkage and the bottom pivot may be respectively larger than the distances between the first joints and the second joints of the upper linkage and the lower linkage. The third links of each set of linkages are curved. The locking mechanism comprises a spring-loaded pin coupled to the support of a first leg of the at least two legs and configured to extend through a hole in one of the first link, the second link, and the third link of one of the upper linkage and the lower linkage of the first leg to lock the desk platform at the desired height. A spring coupled to a first leg of the at least two legs, wherein the spring is configured to counteract a torsional force in the set of linkages in the first leg created by a weight of the desk platform and decrease the force required to lift the desk platform. The first upper pivot, the first lower pivot, the second upper pivot, the second lower pivot, the top pivot, the bottom pivot, the first joint and the second joint of the upper linkage, and the first joint and the second joint of the lower linkage of each leg of the at least two legs each comprises a bearing assembly.

Aspects of this document also relate to an adjustable desk, comprising a desk platform having an adjustable height, and at least two legs configured to support the desk platform and allow a user to adjust the height of the desk platform, wherein a difference between a maximum height and a minimum height of the desk platform is at least 13 inches, each leg of the at least two legs comprising, a base having a first upper pivot and a second upper pivot, a support fixedly coupled to a bottom surface of the desk platform and having a top pivot, and at least one linkage joining the base to the support, the at least one linkage comprising an upper linkage, wherein the upper linkage comprises a first link, a second link pivotally coupled to the first link at a first joint, and a third link pivotally coupled to the second link at a second joint, wherein the first link of the upper linkage is pivotally coupled to the base at the first upper pivot, the second link of the upper linkage is pivotally coupled to the support at the top pivot, and the third link of the upper linkage is pivotally coupled to the base at the second upper pivot, and wherein the first joint of the upper linkage is positioned between the top pivot and the second joint of the upper linkage.

Particular embodiments may include one or more of the following features. A distance between the first joint of the upper linkage and the top pivot is larger than the distance between the first joint and the second joint of the upper linkage. For each leg of the at least two legs, a distance between the first upper pivot and the first joint of the upper linkage is equal to a distance between the first joint and the second joint of the upper linkage. A locking mechanism configured to lock the desk platform at a desired height by limiting rotation of the links of each of the at least one linkage. The locking mechanism comprises a spring-loaded pin configured to extend through a hole in one of the first link, the second link, and the third link of the upper linkage of a first leg of the at least two legs to lock the desk platform at the desired height. A spring coupled to a first leg of the at least two legs, wherein the spring is configured to counteract a torsional force in the set of linkages in the first leg created by a weight of the desk platform and decrease the force required to lift the desk platform.

Aspects of the disclosure also relate to an adjustable desk, comprising a desk platform having an adjustable height, and at least one leg configured to support the desk platform and allow a user to adjust the height of the desk platform, each leg of the at least one leg comprising a base having a first upper pivot and a second upper pivot, a support coupled to a bottom surface of the desk platform and having a top pivot, and at least one linkage joining the base to the support, the at least one linkage comprising an upper linkage, wherein the upper linkage comprises a first link, a second link pivotally coupled to the first link at a first joint, and a third link pivotally coupled to the second link at a second joint, wherein the first link of the upper linkage is pivotally coupled to the base at the first upper pivot, the second link of the upper linkage is pivotally coupled to the support at the top pivot, and the third link of the upper linkage is pivotally coupled to the base at the second upper pivot, wherein the first joint of the upper linkage is positioned between the top pivot and the second joint of the upper linkage.

Particular embodiments may comprise one or more of the following features. A difference between a maximum height and a minimum height of the desk platform is at least 13 inches. For each leg of the at least one leg, a distance between the first upper pivot and the first joint of the upper linkage is equal to a distance between the first joint and the second joint of the upper linkage. For each leg of the at least one leg, a distance between the first joint of the upper linkage and the top pivot is larger than the distance between the first joint and the second joint of the upper linkage. The at least one leg is at least two legs configured to support the desk platform. A locking mechanism configured to lock the desk platform at a desired height by limiting rotation of the links of each of the at least one linkage. The locking mechanism comprises a spring-loaded pin configured to extend through a hole in one of the first link, the second link, and the third link of the upper linkage of a first leg of the at least one leg to lock the desk platform at the desired height. A spring coupled to a first leg of the at least two legs, wherein the spring is configured to counteract a torsional force in the set of linkages in the first leg created by a weight of the desk platform and decrease the force required to lift the desk platform.

The foregoing and other aspects, features, applications, and advantages will be apparent to those of ordinary skill in the art from the specification, drawings, and the claims. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112 (f). Thus, the use of the words "function," "means" or "step" in the Detailed Description or Description of the Drawings or claims is not intended to somehow indicate a desire to invoke the special provisions of 35 U.S.C. § 112 (f), to define the invention. To the contrary, if the provisions of 35 U.S.C. § 112 (f) are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112 (f). Moreover, even if the provisions of 35 U.S.C. § 112 (f) are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those of ordinary skill in the art from the specification, drawings, and the claims.

BRIEF DESCRIPTION OF THE DRAWINGS

Implementations will hereinafter be described in conjunction with the appended drawings, where like designations denote like elements, and.

Figure 1:
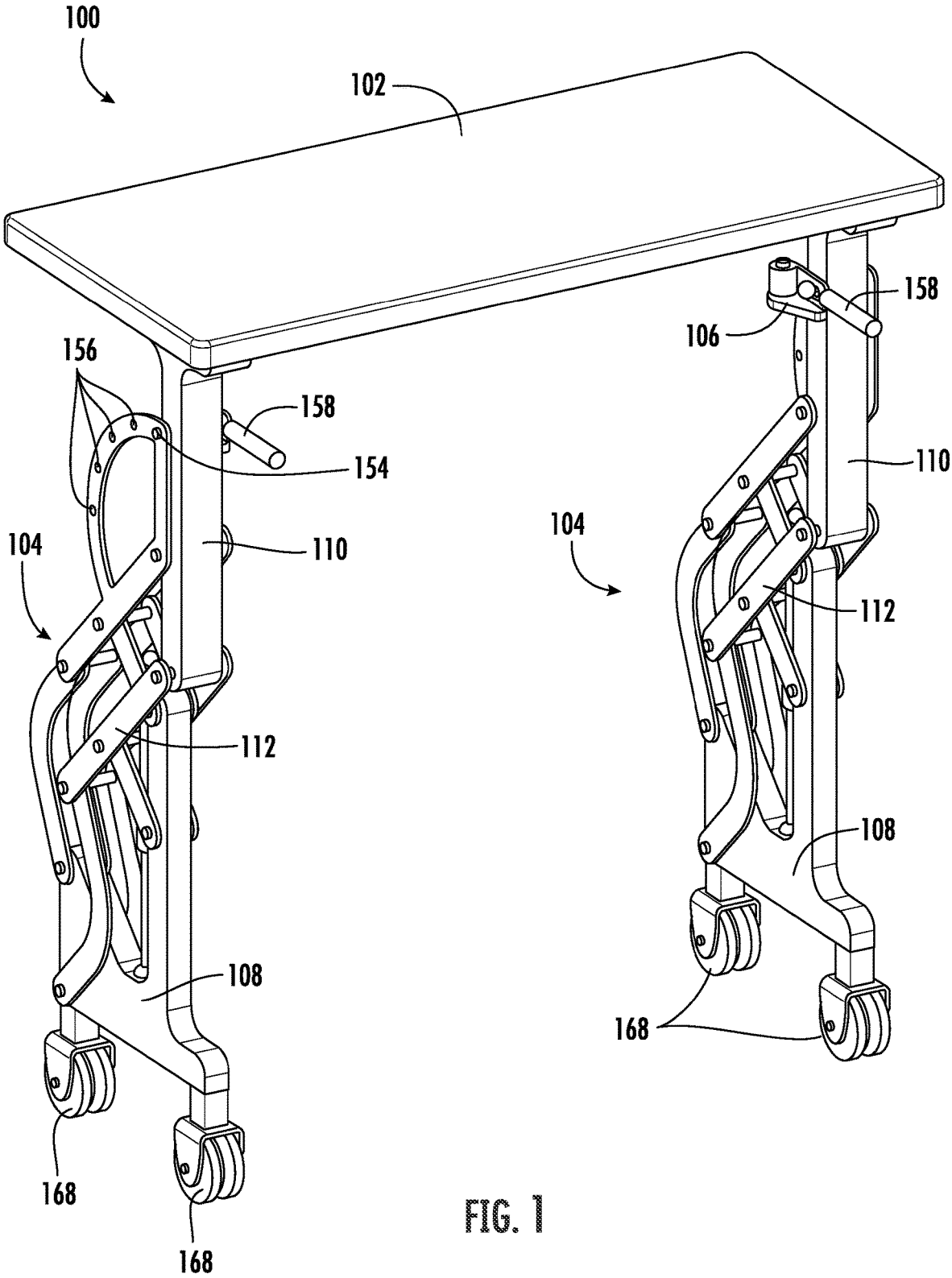
FIG. 1 is a perspective view of a height adjustable desk.
Figure 2:
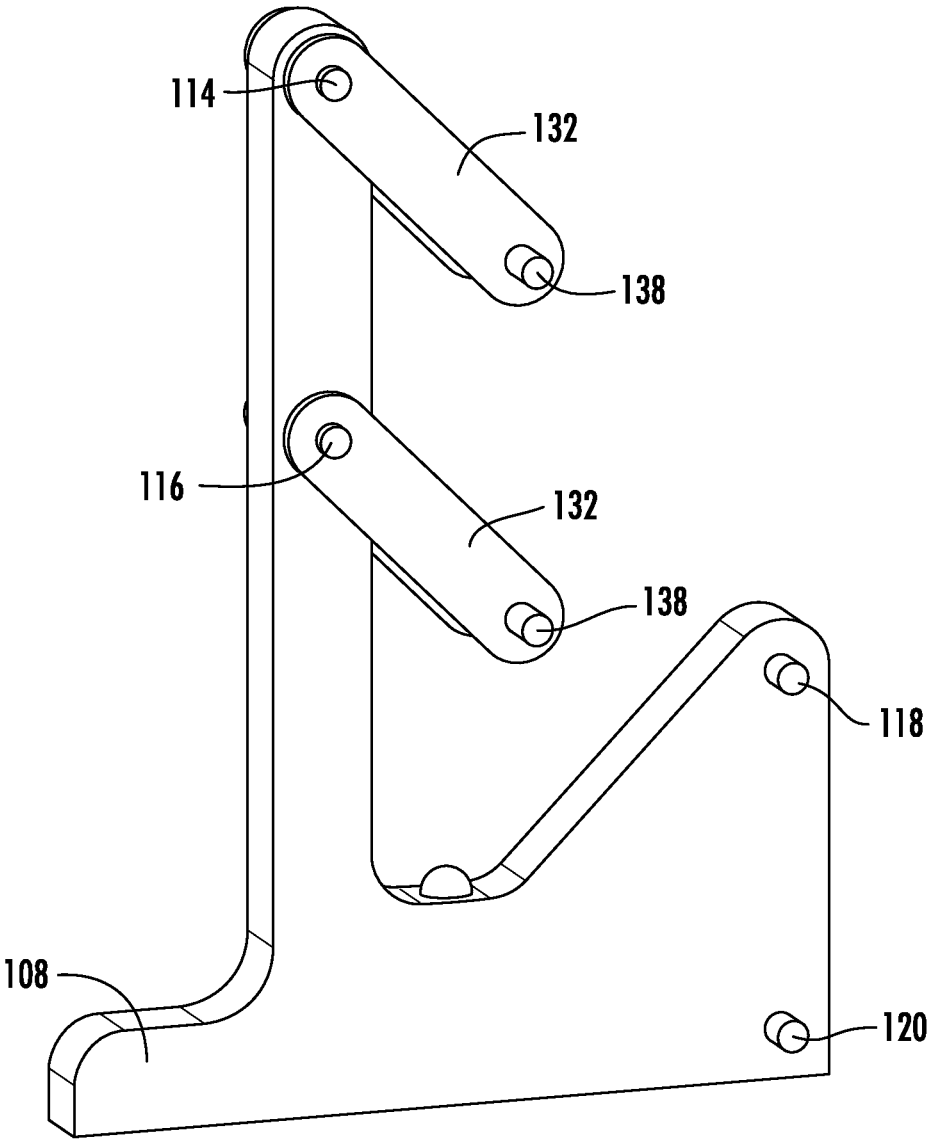
FIG. 2 is a perspective view of a portion of a leg of the height adjustable desk shown in FIG. 1, showing the first links of a set of linkages and the base.
Figure 3:
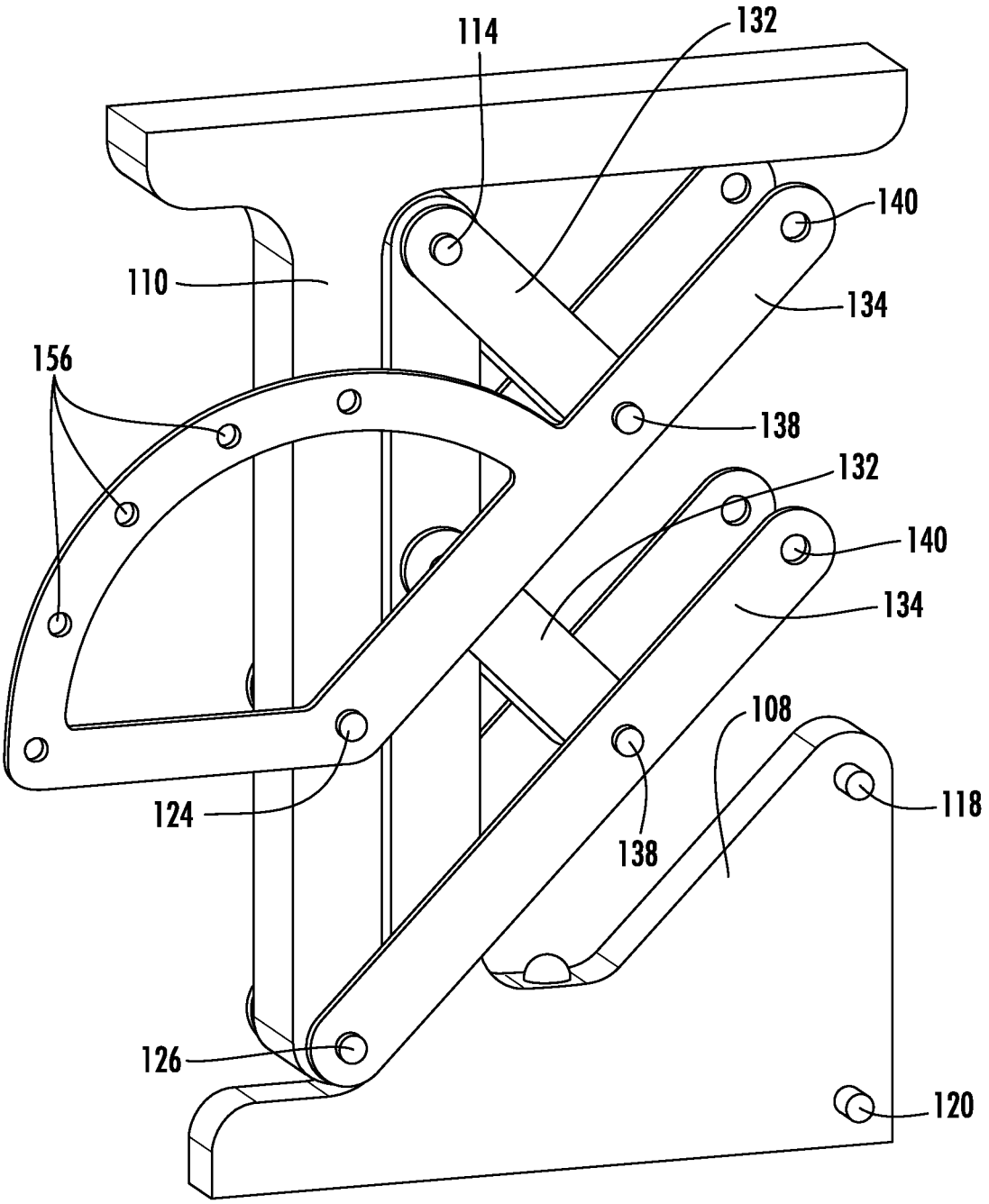
FIG. 3 is a perspective view of a portion of a leg of the height adjustable desk shown in FIG. 1, showing the first and second links of a set of linkages, the base, and the support.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of implementations.

DETAILED DESCRIPTION

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of implementations that are described in many different forms, there is shown in the drawings and will herein be described in detail particular implementations with the understanding that the present disclosure is to be considered as an exemplification of the principles of the disclosed methods and systems, and is not intended to limit the broad aspect of the disclosed concepts to the implementations illustrated.

In the following description, reference is made to the accompanying drawings which form a part hereof, and which show by way of illustration possible implementations. It is to be understood that other implementations may be utilized, and structural, as well as procedural, changes may be made without departing from the scope of this document. As a matter of convenience, various components will be described using exemplary materials, sizes, shapes, dimensions, and the like. However, this document is not limited to the stated examples and other configurations are possible and within the teachings of the present disclosure. As will become apparent, changes may be made in the function and/or arrangement of any of the elements described in the disclosed exemplary implementations without departing from the spirit and scope of this disclosure.

The present disclosure is related to an adjustable desk 100. As shown in FIG. 1, the adjustable desk 100 may have a desk platform 102, at least one leg 104, and a locking mechanism 106. In some embodiments, the adjustable desk 100 has at least two legs 104. The adjustable desk 100 is configured to allow a user to set the desk platform 102 at a variety of heights above the floor or other surface which supports the adjustable desk 100, thus allowing the user to select a desired height and easily move the desk platform 102 to that height. The desk platform 102 thus has an adjustable height. The desk platform 102 may have a planar top surface.

The at least one leg 104 is configured to support the desk platform 102 and allow the user to adjust the height of the desk platform 102, as will be described in more detail below. The legs 104 may be configured such that the desk platform 102 has a maximum height 105 above which the legs 104 cannot raise the desk platform 102 (see FIG. 8) and a minimum height 107 below which the legs 104 cannot lower the desk platform 102 (see FIG. 7). The difference between the maximum height 105 and the minimum height 107 may be at least 13 inches. In some embodiments, the difference between the maximum height 105 and the minimum height 107 may be at least 20 inches. As shown in FIGS. 1-5, each leg 104 may have a base 108, a support 110, and a set of linkages 112. The base 108 is configured to rest on a surface and support the adjustable desk 100. The base 108 has a plurality of pivot points at which the set of linkages 112 are pivotally coupled to the base 108. The plurality of pivot points may include a first upper pivot 114, a first lower pivot 116, a second upper pivot 118, and a second lower pivot 120. The first upper pivot 114 may be positioned above the first lower pivot 116 and the second upper pivot 118 may be positioned above the second lower pivot 120. In some embodiments the first upper pivot 114 is directly above the first lower pivot 116 and the second upper pivot 118 is directly above the second lower pivot 120. Additionally, the distance between the first upper pivot 114 and the first lower pivot 116 may be equal to the distance between the second upper pivot 118 and the second lower pivot 120.

Figure 7:
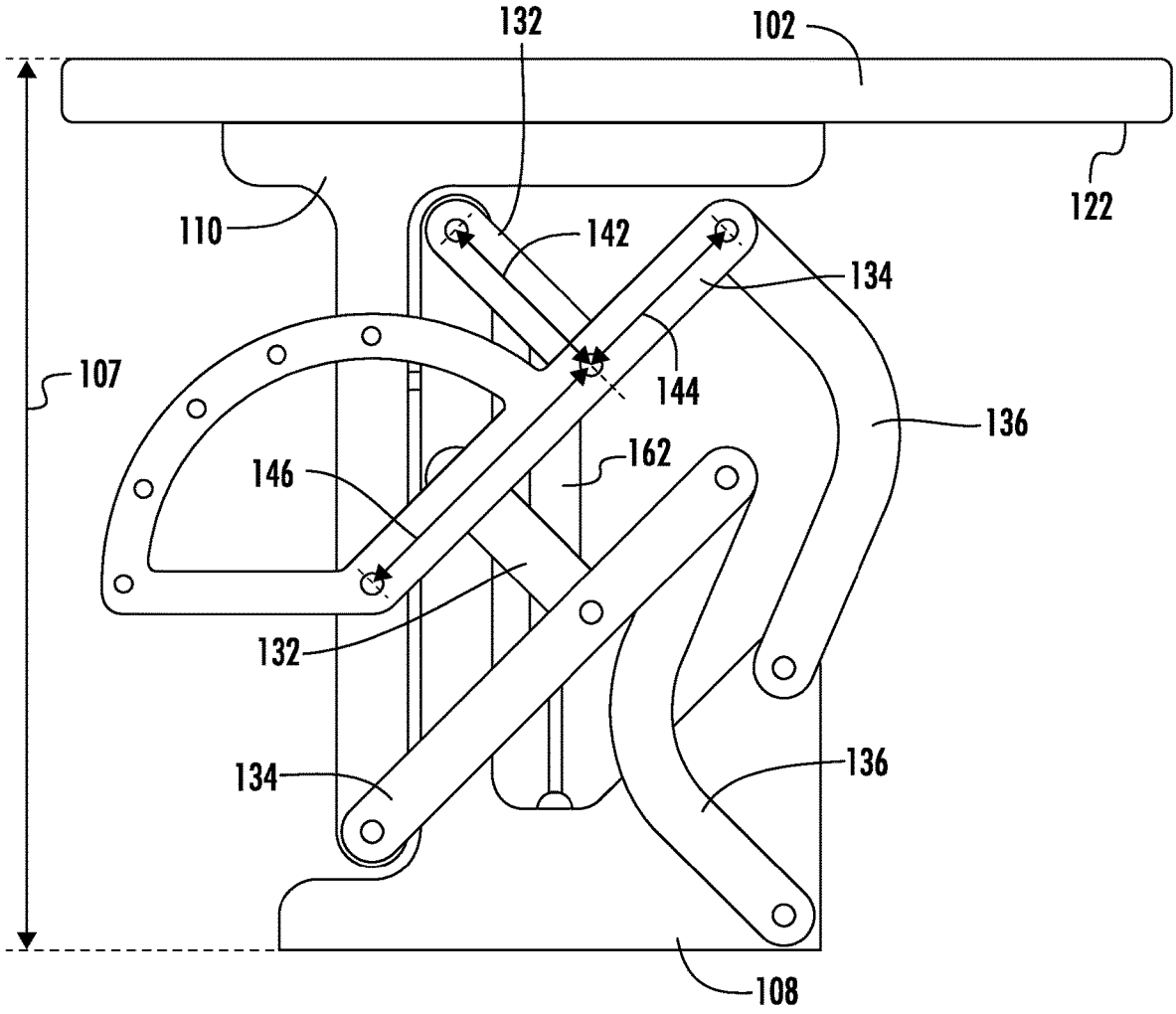
FIG. 7 is a side view of a leg of the height adjustable desk shown in FIG. 1 with the desk platform at the minimum height.
Figure 8:
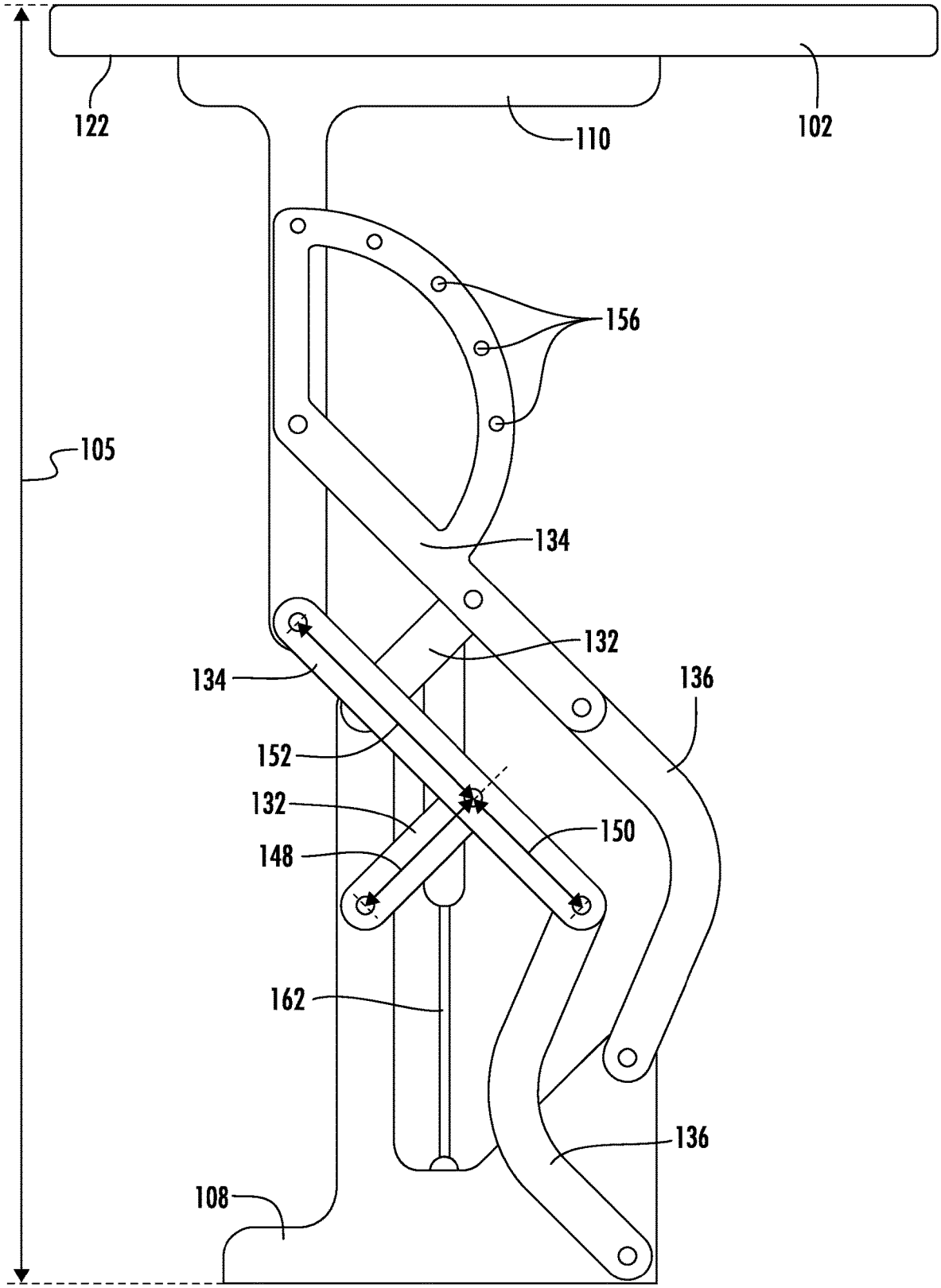
FIG. 8 is a side view of a leg of the height adjustable desk shown in FIG. 1 with the desk platform at the maximum height.
Figure 9:
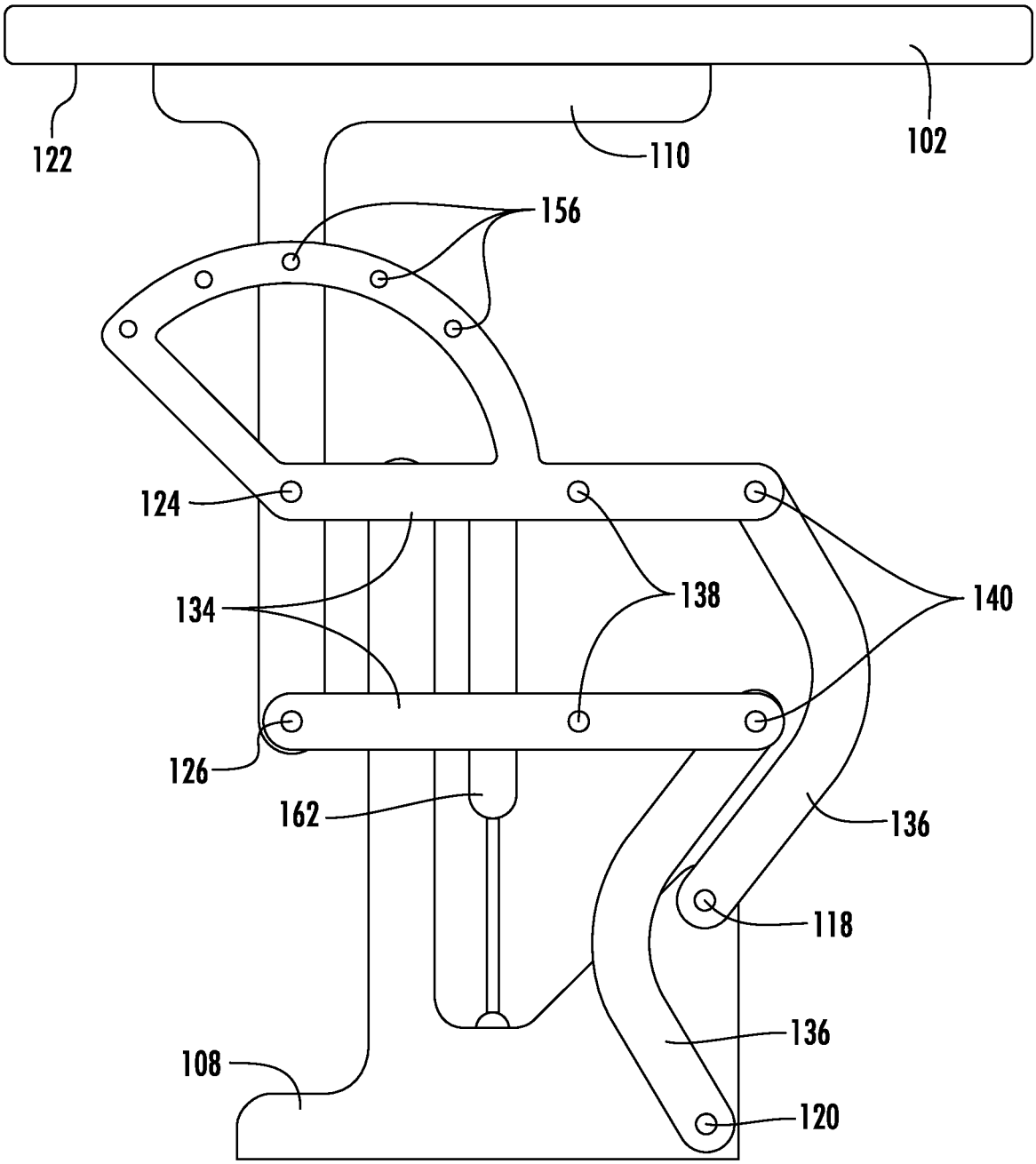
FIG. 9 is a side view of a leg of the height adjustable desk shown in FIG. 1 with the desk platform between the minimum height and the maximum height.

The support 110 may be coupled to a bottom surface 122 of the desk platform 102 (see FIGS. 7-9). In some embodiments, the support 110 may be coupled to a side of the desk platform 102 or some other component of the desk platform 102. The support 110 may be fixedly coupled to the desk platform 102 or coupled in some other manner, such as hingedly, or slidingly. Similar to the base 108, the support 110 may have a pivot point or a plurality of pivot points where the support 110 is pivotally coupled to the set of linkages 112, including a top pivot 124 and a bottom pivot 126.

Figure 4:
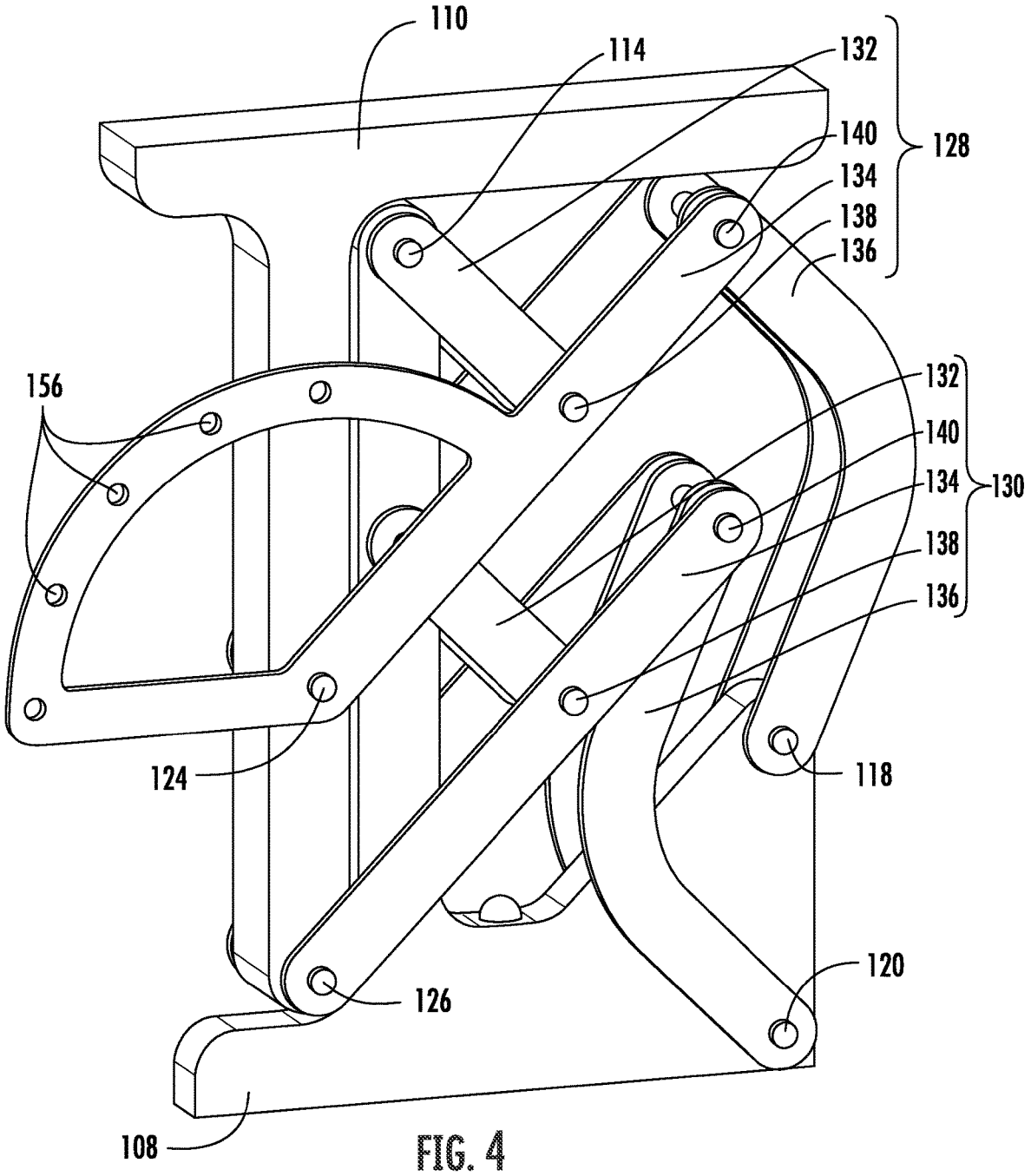
FIG. 4 is a perspective view of a portion of a leg of the height adjustable desk shown in FIG. 1, showing a set of linkages, the base, and the support.
Figure 5:
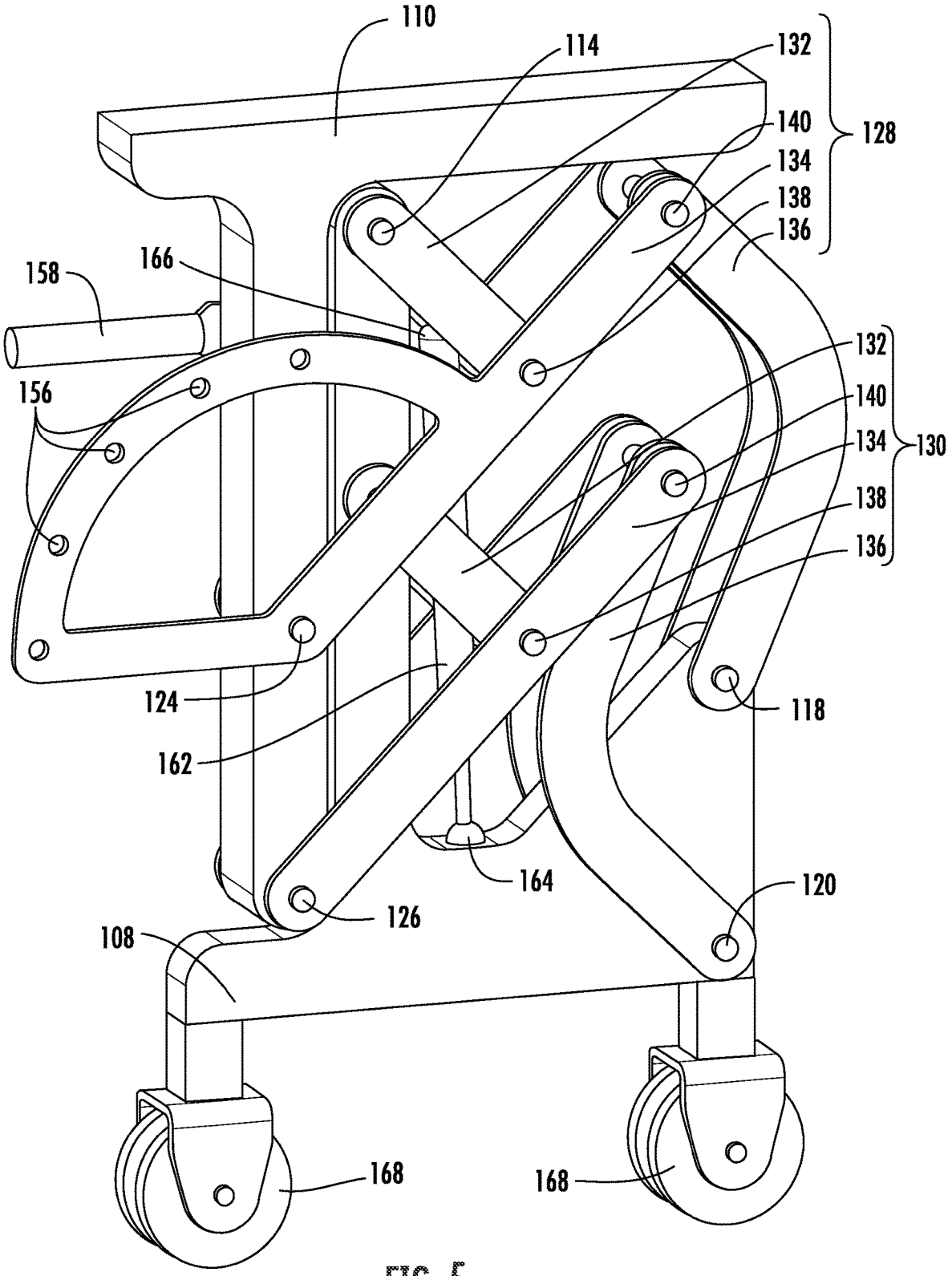
FIG. 5 is a perspective view of a leg of the height adjustable desk shown in FIG. 1.
Figure 6:
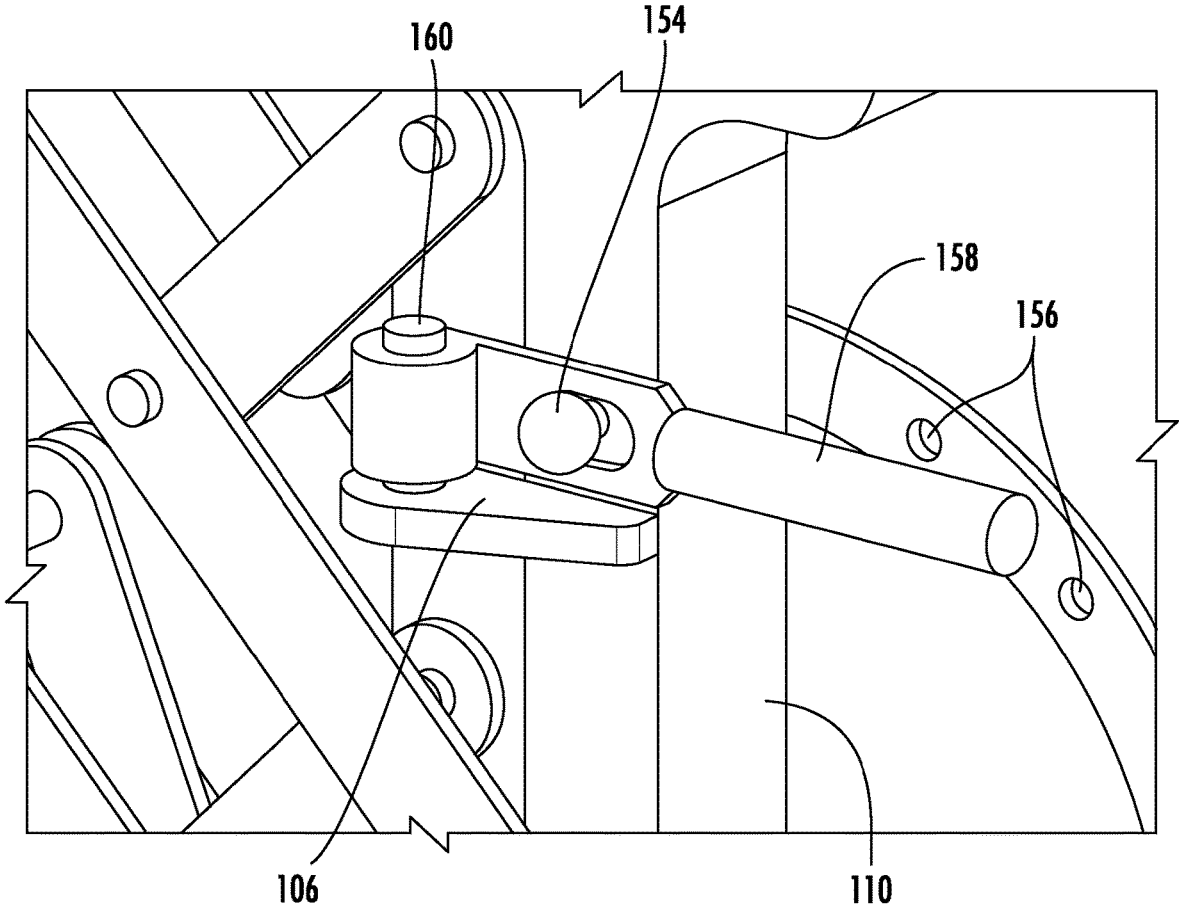
FIG. 6 is a close-up view of the locking mechanism of the height adjustable desk shown in FIG. 1.

The set of linkages 112 of each leg 104 joins the base 108 of that leg 104 to the support 110 of that leg 104. Each set of linkages 112 may comprise an upper linkage 128 and a lower linkage 130. The upper linkage 128 and the lower linkage 130 may have the same components and features. For example, in some embodiments, the upper linkage 128 and the lower linkage 130 are formed with the same links arranged in the same configuration, thus providing the same motion between the endpoints of each linkage. Each of the upper linkage 128 and the lower linkage 130 may individually comprise a first link 132, a second link 134, and a third link 136. The second link 134 may be pivotally coupled to the first link 132 at a first joint 138, and the third link 136 may be pivotally coupled to the second link 134 at a second joint 140. In some embodiments, each link, including the first link 132, the second link 134, and the third link 136, is formed as a straight, elongated piece. However, as known in the art, the motion of a linkage is determined by the distances and angles between the joints, and not by the shape of the actual piece. Thus, each link could be any shape. As shown in FIGS. 4-5, the third links 136 of each set of linkages 112 may be curved to accommodate the desired motion of the linkages 112.

The upper linkage 128 and the lower linkage 130 may be attached to the base 108 and to the support 110 at specific joints and the joints may have specific distances between them to produce the desired motion of the desk platform 102 as the height of the desk platform 102 is adjusted. For example, as shown in FIGS. 4-5, the first link 132 of the upper linkage 128 may be pivotally coupled to the base 108 at the first upper pivot 114, the second link 134 of the upper linkage 128 may be pivotally coupled to the support 110 at the top pivot 124, and the third link 136 of the upper linkage 128 may be pivotally coupled to the base 108 at the second upper pivot 118. The first joint 138 of the upper linkage 128 may be positioned between the top pivot 124 and the second joint 140 of the upper linkage 128. In some embodiments, a distance 142 between the first upper pivot 114 and the first joint 138 of the upper linkage 128 may be equal or substantially equal to a distance 144 between the first joint 138 and the second joint 140 of the upper linkage 128. In addition, a distance 146 between the first joint 138 of the upper linkage 128 and the top pivot 124 may be larger than the distance 144 between the first joint 138 and the second joint 140 of the upper linkage 128. These distances cause the desk platform 102 to move in a slight arc as its height is adjusted but allows the base 108 and the support 110 to nest together, having the same plane of motion, rather than needing to be offset from each other. Additionally, because the base 108 and the support 110 have the same plane of motion, a more balanced load is placed on the joints and bearings. In some embodiments, the distance 146 between the first joint 138 of the upper linkage 128 and the top pivot 124 may be equal or substantially equal to the distance 144 between the first joint 138 and the second joint 140 of the upper linkage 128. In such an embodiment, the desk platform 102 moves in a substantially straight vertical line as its height is adjusted.

Similarly, the first link 132 of the lower linkage 130 may be pivotally coupled to the base 108 at the first lower pivot 116, the second link 134 of the lower linkage 130 may be pivotally coupled to the support 110 at the bottom pivot 126, and the third link 136 of the lower linkage 130 may be pivotally coupled to the base 108 at the second lower pivot 120. The first joint 138 of the lower linkage 130 may be positioned between the bottom pivot 126 and the second joint 140 of the lower linkage 130. In some embodiments, a distance 148 between the first lower pivot 116 and the first joint 138 of the lower linkage 130 may be equal or substantially equal to a distance 150 between the first joint 138 and the second joint 140 of the lower linkage 130. In addition, a distance 152 between the first joint 138 of the lower linkage 130 and the bottom pivot 126 may be larger than the distance 150 between the first joint 138 and the second joint 140 of the lower linkage 130. As with the upper linkage 128, these distances cause the desk platform 102 to move in a slight arc as its height is adjusted but allows the base 108 and the support 110 to nest together, having the same plane of motion, rather than needing to be offset from each other. Additionally, because the base 108 and the support 110 have the same plane of motion, a more balanced load is placed on the joints and bearings. In some embodiments, the distance 152 between the first joint 138 of the lower linkage 130 and the bottom pivot 126 may be equal or substantially equal to the distance 150 between the first joint 138 and the second joint 140 of the lower linkage 130. In such an embodiment, the desk platform 102 moves in a substantially straight vertical line as its height is adjusted.

Thus, the first links 132 of the upper linkage 128 and the lower linkage 130 may be pivotally coupled to the base 108 at the first upper pivot 114 and the first lower pivot 116, respectively, the second links 134 of the upper linkage 128 and the lower linkage 130 may be pivotally coupled to the support 110 at the top pivot 124 and the bottom pivot 126, respectively, and the third links 136 of the upper linkage 128 and the lower linkage 130 may be pivotally coupled to the base 108 at the second upper pivot 118 and the second lower pivot 120, respectively. The first joints 138 of the upper linkage 128 and the lower linkage 130 may be respectively positioned between the top pivot 124 and the second joint 140 of the upper linkage 128 and between the bottom pivot 126 and the second joint 140 of the lower linkage 130. The distance 142 between the first upper pivot 114 and the first joint 138 of the upper linkage 128 and the distance 148 between the first lower pivot 116 and the first joint 138 of the lower linkage 130 may be respectively equal or substantially equal to the distances 144 and 150 between the first joints 138 and the second joints 140 of the upper linkage 128 and the lower linkage 130. The distance 146 between the first joint 138 of the upper linkage 128 and the top pivot 124 and the distance 152 between the first joint 138 of the lower linkage 130 and the bottom pivot 126 may be respectively larger than the distances 144 and 150 between the first joints 138 and the second joints 140 of the upper linkage 128 and the lower linkage 130 but allows the base 108 and the support 110 to nest together, having the same plane of motion, rather than needing to be offset from each other. Additionally, because the base 108 and the support 110 have the same plane of motion, a more balanced load is placed on the joints and bearings. In some embodiments, the distance 146 between the first joint 138 of the upper linkage 128 and the top pivot 124 and the distance 152 between the first joint 138 of the lower linkage 130 and the bottom pivot 126 may respectively be equal or substantially equal to the distances 144 and 150 between the first joints 138 and the second joints 140 of the upper linkage 128 and the lower linkage 130. In such an embodiment, the desk platform 102 moves in a substantially straight vertical line as its height is adjusted.

Figure 10:
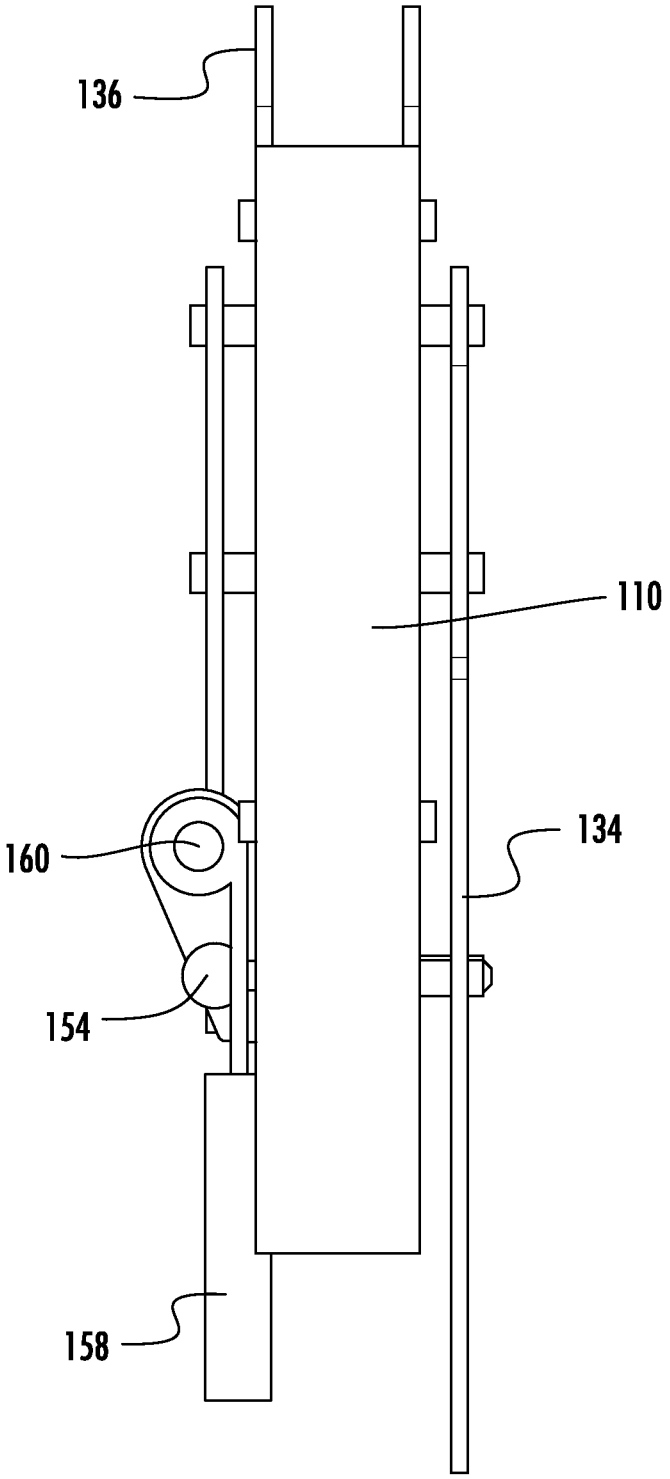
FIG. 10 is a top view of a leg of the height adjustable desk shown in FIG. 1.

The locking mechanism 106 is configured to lock the desk platform 102 at the desired height. This may be done by limiting the rotation of any of the links, including the first links 132, the second links 134, and the third links 136 of each of the sets of linkages 112. For example, the locking mechanism 106 may comprise a spring-loaded pin 154 that is coupled to any component of the adjustable desk 100 including the desk platform 102, one of the bases 108, one of the supports 110, or one of the linkages 112. As a specific example shown in FIGS. 5-10, the pin 154 may be coupled to a first leg 104 of the at least two legs 104. One of the links, including the first links 132, the second links 134, and the third links 136 of the upper linkages 128 and the lower linkages 130, may be shaped to have a plurality of holes 156 arranged in an arc such that, as the desk platform 102 is raised and lowered, each of the holes 156 sequentially passes the pin 154. The pin 154 may be configured to extend through each of the holes 156 as they align with the pin 154. Thus, when the desk platform 102 is at the desired height, the pin 154 can be inserted into the hole 156 nearest the pin 154, thus limiting rotation of the links and locking the desk platform 102 at the desired height. The pin 154 may be coupled to a handle 158 that is configured to facilitate manipulation of the pin 154 to adjust the height of the desk platform 102. For example, as shown in FIG. 10, the handle 158 may be coupled to one end of the pin 154 and the other end of the pin 154 may be configured to extend through the hole 156. To adjust the height of the desk platform 102, the handle can be rotated away from the hole 156, thus pulling the pin 154 out of the hole 156. As mentioned above, the pin 154 may be spring-loaded. This spring-loading may occur at the handle axis 160 of the handle 158.

The adjustable desk 100 may also have a spring 162 that is configured to assist a user in adjusting the height of the desk platform 102. The weight of the desk platform 102 creates a unidirectional torsional force in each of the links, causing the links to be biased to turn in a direction that lowers the desk platform 102 closer to the ground. Thus, the spring 162 may be configured to counteract this torsional force, and thus decrease the force required to lift the desk platform 102. For example, the spring 162 may be a compression spring or a pneumatic spring connected between a link and another component of the adjustable desk 100 or between two links, thus exerting a force that counters the weight of the desk platform 102. As a particular example, shown in FIG. 5, a first end 164 of the spring 162 may be coupled to the base 108 of a first leg 104 and a second end 166 of the spring 162 may be coupled to one of the first link 132 and the second link 134 of one of the upper linkage 128 and the lower linkage 130 of the first leg 104. In this embodiment, the spring 162 pushes the link away from the base 108, thus helping to lift the desk platform 102. As another example, the spring 162 may be coupled between the support 110 and one of the first link 132 and the second link 134 of one of the upper linkage 128 and the lower linkage 130 of the first leg 104. The spring 162 may also be coupled between the first link 132 and the second link 134, or between the second link 134 and the third link 136 of one of the linkages. Coupling the spring 162 across other joints or pivots may also be implemented, as long as the spring 162 thus counteracts a torsional force created by the weight of the desk platform 102.

Each of the joints and pivots of the adjustable desk 100 may comprise a bearing assembly configured to decrease the friction of the joint. For example, the first upper pivot 114, the first lower pivot 116, the second upper pivot 118, the second lower pivot 120, the top pivot 124, the bottom pivot 126, the first joint 138 and the second joint 140 of the upper linkage 128, and the first joint 138 and the second joint 140 of the lower linkage 130 may each comprise a bearing assembly. The adjustable desk 100 may be mounted onto a plurality of wheels 168. The wheels 168 may help move the adjustable desk 100 to a desired location. The wheels 168 may be configured to guide the adjustable desk 100 along a track or other supporting structure.

It will be understood that implementations of an adjustable desk are not limited to the specific assemblies, devices and components disclosed in this document, as virtually any assemblies, devices and components consistent with the intended operation of an adjustable desk may be used. Accordingly, for example, although particular adjustable desks, and other assemblies, devices and components are disclosed, such may include any shape, size, style, type, model, version, class, measurement, concentration, material, weight, quantity, and/or the like consistent with the intended operation of adjustable desks. Implementations are not limited to uses of any specific assemblies, devices and components; provided that the assemblies, devices and components selected are consistent with the intended operation of an adjustable desk.

Accordingly, the components defining any adjustable desk may be formed of any of many different types of materials or combinations thereof that can readily be formed into shaped objects provided that the materials selected are consistent with the intended operation of an adjustable desk. For example, the components may be formed of: polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; glasses (such as quartz glass), carbon-fiber, aramid-fiber, any combination thereof, and/or other like materials; composites and/or other like materials; metals, such as zinc, magnesium, titanium, copper, lead, iron, steel, carbon steel, alloy steel, tool steel, stainless steel, brass, nickel, tin, antimony, pure aluminum, 1100 aluminum, aluminum alloy, any combination thereof, and/or other like materials; alloys, such as aluminum alloy, titanium alloy, magnesium alloy, copper alloy, any combination thereof, and/or other like materials; any other suitable material; and/or any combination of the foregoing thereof. In instances where a part, component, feature, or element is governed by a standard, rule, code, or other requirement, the part may be made in accordance with, and to comply under such standard, rule, code, or other requirement.

Various adjustable desks may be manufactured using conventional procedures as added to and improved upon through the procedures described here. Some components defining an adjustable desk may be manufactured simultaneously and integrally joined with one another, while other components may be purchased pre-manufactured or manufactured separately and then assembled with the integral components. Various implementations may be manufactured using conventional procedures as added to and improved upon through the procedures described here.

Accordingly, manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components.

It will be understood that methods for manufacturing or assembling adjustable desks are not limited to the specific order of steps as disclosed in this document. Any steps or sequence of steps of the assembly of an adjustable desk indicated herein are given as examples of possible steps or sequence of steps and not as limitations, since various assembly processes and sequences of steps may be used to assemble adjustable desks.

The implementations of an adjustable desk described are by way of example or explanation and not by way of limitation. Rather, any description relating to the foregoing is for the exemplary purposes of this disclosure, and implementations may also be used with similar results for a variety of other applications employing an adjustable desk.

What is claimed is:

1. An adjustable desk, comprising:

a desk platform having an adjustable height;

at least two legs configured to support the desk platform and allow a user to adjust the height of the desk platform, wherein a difference between a maximum height and a minimum height of the desk platform is at least 13 inches, each leg of the at least two legs comprising:

a base having a first upper pivot, a first lower pivot, a second upper pivot, and a second lower pivot;

a support fixedly coupled to a bottom surface of the desk platform and having a top pivot and a bottom pivot; and a set of linkages joining the base to the support, the set of linkages comprising an upper linkage and a lower linkage, wherein each of the upper linkage and the lower linkage individually comprises a first link, a second link pivotally coupled to the first link at a first joint, and a third link pivotally coupled to the second link at a second joint;

wherein the first links of the upper linkage and the lower linkage are pivotally coupled to the base at the first upper pivot and the first lower pivot, respectively, the second links of the upper linkage and the lower linkage are pivotally coupled to the support at the top pivot and the bottom pivot, respectively, and the third links of the upper linkage and the lower linkage are pivotally coupled to the base at the second upper pivot and the second lower pivot, respectively; and wherein the first joints of the upper linkage and the lower linkage are respectively positioned between the top pivot and the second joint of the upper linkage and between the bottom pivot and the second joint of the lower linkage and wherein a distance between the first upper pivot and the first joint of the upper linkage and a distance between the first lower pivot and the first joint of the lower linkage are respectively equal to distances between the first joints and the second joints of the upper linkage and the lower linkage; and a locking mechanism configured to lock the desk platform at a desired height by limiting rotation of the links of each of the sets of linkages.

2. The adjustable desk of claim 1, wherein a distance between the first joint of the upper linkage and the top pivot and a distance between the first joint of the lower linkage and the bottom pivot are respectively larger than the distances between the first joints and the second joints of the upper linkage and the lower linkage.

3. The adjustable desk of claim 1, wherein the third links of each set of linkages are curved.

4. The adjustable desk of claim 1, wherein the locking mechanism comprises a pin coupled to the support of a first leg of the at least two legs and configured to extend through a hole in one of the first link, the second link, and the third link of one of the upper linkage and the lower linkage of the first leg to lock the desk platform at the desired height.

5. The adjustable desk of claim 1, further comprising a spring coupled to a first leg of the at least two legs, wherein the spring is configured to counteract a torsional force in the set of linkages in the first leg created by a weight of the desk platform and decrease the force required to lift the desk platform.

6. The adjustable desk of claim 1, wherein the first upper pivot, the first lower pivot, the second upper pivot, the second lower pivot, the top pivot, the bottom pivot, the first joint and the second joint of the upper linkage, and the first joint and the second joint of the lower linkage of each leg of the at least two legs each comprises a bearing assembly.

7. An adjustable desk, comprising:

a desk platform having an adjustable height; and at least two legs configured to support the desk platform and allow a user to adjust the height of the desk platform, wherein a difference between a maximum height and a minimum height of the desk platform is at least 13 inches, each leg of the at least two legs comprising:

a base having a first upper pivot, a first lower pivot, a second upper pivot, and a second lower pivot;

a support fixedly coupled to a bottom surface of the desk platform and having a top pivot and a bottom pivot; and at least one linkage joining the base to the support, the at least one linkage comprising an upper linkage and a lower linkage, wherein each of the upper linkage and the lower linkage individually comprises a first link and a second link pivotally coupled to the first link at a first joint;

wherein the first links of the upper linkage and the lower linkage are pivotally coupled to the base at the first upper pivot and the first lower pivot, respectively, the second links of the upper linkage and the lower linkage are pivotally coupled to the support at the top pivot and the bottom pivot, respectively, and the second links of the upper linkage and the lower linkage are pivotally coupled to the base.

8. The adjustable desk of claim 7, wherein a distance between the first joint of the upper linkage and the top pivot is larger than the distance between the first joint and a second joint on the second link of the upper linkage.

9. The adjustable desk of claim 7, wherein, for each leg of the at least two legs, a distance between the first upper pivot and the first joint of the upper linkage is equal to a distance between the first joint and a second joint on the second link of the upper linkage.

10. The adjustable desk of claim 7, further comprising a locking mechanism configured to lock the desk platform at a desired height by limiting rotation of the links of each of the at least one linkage.

11. The adjustable desk of claim 10, wherein the locking mechanism comprises a pin configured to extend through a hole in one of the first link and the second link of the upper linkage of a first leg of the at least two legs to lock the desk platform at the desired height.

12. The adjustable desk of claim 7, further comprising a spring coupled to a first leg of the at least two legs, wherein the spring is configured to counteract a torsional force in the at least one linkage in the first leg created by a weight of the desk platform and decrease the force required to lift the desk platform.

13. An adjustable desk, comprising:

a desk platform having an adjustable height; and at least one leg configured to support the desk platform and allow a user to adjust the height of the desk platform, each leg of the at least one leg comprising:

a base having a first upper pivot, a first lower pivot, a second upper pivot, and a second lower pivot;

a support coupled to a bottom surface of the desk platform and having a top pivot and a bottom pivot; and at least one linkage joining the base to the support, the at least one linkage comprising an upper linkage and a lower linkage, wherein each of the upper linkage and the lower linkage individually comprises a first link, a second link pivotally coupled to the first link at a first joint, and a third link pivotally coupled to the second link at a second joint;

wherein the first links of the upper linkage and the lower linkage are pivotally coupled to the base at the first upper pivot and the first lower pivot, respectively, the second links of the upper linkage and the lower linkage are pivotally coupled to the support at the top pivot and the bottom pivot, respectively, and the third links of the upper linkage and the lower linkage are pivotally coupled to the base at the second upper pivot and the second lower pivot, respectively, wherein the first joint of the upper linkage is positioned between the top pivot and the second joint of the upper linkage.

14. The adjustable desk of claim 13, wherein a difference between a maximum height and a minimum height of the desk platform is at least 13 inches.

15. The adjustable desk of claim 13, wherein, for each leg of the at least one leg, a distance between the first upper pivot and the first joint of the upper linkage is equal to a distance between the first joint and the second joint of the upper linkage.

16. The adjustable desk of claim 13, wherein, for each leg of the at least one leg, a distance between the first joint of the upper linkage and the top pivot is larger than the distance between the first joint and the second joint of the upper linkage.

17. The adjustable desk of claim 13, wherein the at least one leg is at least two legs configured to support the desk platform.

18. The adjustable desk of claim 13, further comprising a locking mechanism configured to lock the desk platform at a desired height by limiting rotation of the links of each of the at least one linkage.

19. The adjustable desk of claim 18, wherein the locking mechanism comprises a pin configured to extend through a hole in one of the first link, the second link, and the third link of the upper linkage of a first leg of the at least one leg to lock the desk platform at the desired height.

20. The adjustable desk of claim 13, further comprising a spring coupled to a first leg of the at least one leg, wherein the spring is configured to counteract a torsional force in the at least one linkage in the first leg created by a weight of the desk platform and decrease the force required to lift the desk platform.

* * * * *